US007810508B2

(12) United States Patent
Wyss-Peters et al.

(10) Patent No.: US 7,810,508 B2
(45) Date of Patent: Oct. 12, 2010

(54) SMOKING ARTICLE WITH ENCAPSULATED FLAVOURANT

(75) Inventors: Anne Wyss-Peters, Petaling Jaya (MY); Yves Jordil, Lugrin (FR); Charles Kuersteiner, Jouxtens-Mezery (CH)

(73) Assignee: Philip Morris USA Inc., Richmond, VA (US)

( * ) Notice: Subject to any disclaimer, the term of this patent is extended or adjusted under 35 U.S.C. 154(b) by 466 days.

(21) Appl. No.: 11/892,291

(22) Filed: Aug. 21, 2007

(65) Prior Publication Data

US 2008/0156336 A1 Jul. 3, 2008

(30) Foreign Application Priority Data

Aug. 25, 2006 (EP) ..... 06254451

(51) Int. Cl.
*A24D 1/02* (2006.01)

(52) U.S. Cl. ..... 131/365; 131/352

(58) Field of Classification Search ..... 131/365, 131/352

See application file for complete search history.

(56) References Cited

U.S. PATENT DOCUMENTS

| | | | |
|---|---|---|---|
| 3,550,598 | A | 12/1970 | McGlumphy et al. |
| 3,683,936 | A | 8/1972 | O'Neil |
| 4,687,008 | A | 8/1987 | Houck et al. |
| 5,595,196 | A | 1/1997 | Salonen et al. |

FOREIGN PATENT DOCUMENTS

| | | |
|---|---|---|
| EP | 0 084 246 | 7/1983 |
| EP | 0 503 795 | 9/1992 |
| EP | 1 637 325 | 3/2006 |
| GB | 1 216 574 | 12/1970 |
| GB | 1 349 537 | 4/1974 |
| GB | 2 418 654 | 4/2006 |
| WO | WO 94/09653 | 5/1994 |

OTHER PUBLICATIONS

International Preliminary Report on Patentability issued Mar. 3, 2009 for PCT/IB2007/003386.

International Search Report and Written Opinion dated Dec. 2008, for PCT/IB2007/003386.

European Search Report dated Jan. 25, 2007, issued in EP Application No. EP06254451.

*Primary Examiner*—Carlos Lopez

(74) *Attorney, Agent, or Firm*—Buchanan Ingersoll & Rooney PC

(57) ABSTRACT

A filter cigarette comprises a tobacco rod and a filter attached to the tobacco rod by a band of tipping paper. The surface of the band of tipping paper is coated with a solution of cells having at least one flavorant encapsulated therein. In use, when the filter cigarette is placed in the mouth of a consumer, moisture from the consumer's saliva causes the cells provided on the surface of the tipping paper to release the encapsulated flavorant. The cells are preferably yeast cells. The solution of cells may be applied to the band of tipping paper by gravure printing.

10 Claims, 1 Drawing Sheet

SMOKING ARTICLE WITH ENCAPSULATED FLAVOURANT

CROSS-REFERENCE TO RELATED APPLICATION

This application claims priority under 35 U.S.C. §119 to European Application No. 06254451.5, filed Aug. 25, 2006, the entire content of which is hereby incorporated by reference.

FIELD OF THE INVENTION

The present invention relates to a smoking article with encapsulated flavourant provided on the surface of a mouth end portion thereof and more specifically to a smoking article with a plurality of cells having at least one flavourant encapsulated therein provided on the surface of a mouth end portion thereof.

BACKGROUND

Smoking articles including encapsulated flavourants that are released into the mainstream smoke of the smoking articles during combustion in order to modify the smoking characteristics thereof are known in the art.

SUMMARY

According to the present invention there is provided a smoking article having a plurality of cells provided on the surface of a mouth end portion thereof, the cells having at least one flavourant encapsulated therein.

The plurality of cells are capable of releasing the at least one flavourant encapsulated therein upon contact with moisture. In use, upon insertion of the mouth end portion of smoking articles according to the invention into the mouth of a consumer, the at least one flavourant encapsulated in the plurality of cells provided on the mouth end portion is thereby released.

The cells may be any micro-organism cells capable of having at least one flavourant encapsulated therein. The cells should be readily cultivable and suitable for use in food applications. Preferably, the cells are yeast cells. Yeast cells comprise a cell wall made of complex carbohydrates and an internal lipid bi-layer membrane. When the yeast cells come into contact with saliva, the carbohydrates absorb moisture from the saliva and swell, rendering the lipid bi-layer membrane permeable, which results in the release of the at least one flavourant encapsulated within the yeast cells.

The at least one encapsulated flavourant provided on the mouth end portion of smoking articles according to the present invention is released by bringing the cells in which the at least one flavourant is encapsulated into contact with a consumer's saliva, rather than through the combustion of the smoking article. Smoking articles according to the present invention may, therefore, be provided that advantageously deliver enhanced gustatory sensations, without modifying the flavour or other characteristics of the mainstream smoke produced during combustion thereof.

Cells having at least one flavourant encapsulated therein may be applied directly to the surface of smoking articles according to the invention by, for example, gravure or offset printing an aqueous or non-aqueous solution of the cells onto the surface of a mouth end portion of the smoking article or a component thereof. Alternatively or in addition, cells may be deposited on a layer of paper, film or other material, which is adhered or otherwise affixed to the surface of a mouth end portion of the smoking article.

Preferably, the smoking article comprises: a tobacco rod; and a filter attached to the tobacco rod, the plurality of cells being provided on at least a portion of the surface of the filter. Smoking articles according to the present invention comprising a tobacco rod and a filter may have a plurality of cells provided on substantially the entire surface of the filter. Alternatively, the plurality of cells may be provided on a predefined mouth end portion of the filter.

Preferably, the length of the filter is between about 15 mm and about 40 mm.

In preferred embodiments of the invention, the filter is attached to the tobacco rod by a first band of tipping paper and the plurality of cells are deposited on the surface of the first band of tipping paper.

In alternative embodiments of the invention, the filter is attached to the tobacco rod by a first band of tipping paper and the plurality of cells are deposited on the surface of a second band of tipping paper circumscribing at least a mouth end portion of the first band of tipping paper.

Preferably, the length of the first band of tipping paper and, where included, the length of the second band of tipping paper is between about 19 mm and about 45 mm.

Throughout the specification "flavourant" is used to mean any substance capable of producing a gustatory sensation. Preferably, the flavourant produces both a gustatory and an olfactory sensation.

Where the plurality of cells provided on the surface of a mouth end portion of smoking articles according to the present invention are yeast cells, preferably the yeast cells are between about 5 micrometres and about 10 micrometres in diameter.

Yeast cells having flavourants encapsulated therein suitable for use in smoking articles according to the present invention are known in the art and are available from, for example, Micap plc, Wigan, UK.

The number of cells provided on the surface of the mouth end portion of smoking articles according to the invention and the amount of flavourant encapsulated therein is such that insertion of the smoking article into a consumer's mouth releases sufficient flavourant to produce a gustatory sensation. The quantity of cells required to produce a perceptible flavour will depend not only on the size of the cells, but also the nature and concentration of the flavourant or flavourants encapsulated therein. Smoking articles according to the present invention may have thousands of cells provided on the surface of a mouth end portion thereof. For example, smoking articles according to the present invention may have from at least about 5,000 up to about 100,000 or more yeast cells provided on the surface of a mouth end portion thereof.

Smoking articles according to the present invention may have cells containing the same or different flavourants provided on the surface of a mouth end portion thereof. Furthermore, each cell may have more than one flavourant encapsulated therein.

Flavourants that may be useful for the present invention include, but are not limited to, for example, essential oils, oleoresins, absolutes, fruit concentrates, fruit extracts, distillates and natural-artificial chemicals. Examples of flavourants that may be used are tobacco, cinnamon, spearmint, peppermint, vanilla, orange, peach, blueberry, strawberry, cranberry, geranium extract, linalool, coffee, chocolate, menthol, eucalyptus, clove, ginger, citrus and combinations thereof.

According to the invention there is also provided a method of making a smoking article according to the invention comprising a tobacco rod; and a filter attached to the tobacco rod, the method comprising: applying a solution of cells having at least one flavourant encapsulated therein to tipping paper; and circumscribing at least a mouth end portion of the filter with the tipping paper.

In embodiments of the present invention, the method comprises: applying a solution of cells having at least one flavourant encapsulated therein to a first band of tipping paper; and attaching the filter to the tobacco rod with the first band of tipping paper.

In alternative embodiments of the invention, the method comprises: attaching the filter to the tobacco rod with a first band of tipping paper; applying a solution of cells having at least one flavourant encapsulated therein to a second band of tipping paper; and circumscribing at least a mouth end portion of the first band of tipping paper with the second band of tipping paper.

Preferably, the solution of cells is applied to the tipping paper by gravure printing.

Preferably, the plurality of cells are deposited as a coating on the surface of the first band of tipping paper or second band of tipping paper by applying a solution of the cells to the tipping paper by gravure printing.

The cells may be applied to the tipping paper as an aqueous solution or a non-aqueous solution. Organic solvents that may be used in the method of the invention include, but are not limited to, propylene glycol (1,2-propanediol), isopropyl acetate, isopropanol (propan-2-ol), n-propanol (propan-1-ol), ethanol and ethyl acetate. Where a non-aqueous solution of cells is applied to the tipping paper, preferably the solvent is ethyl acetate.

To avoid sedimentation and improve fixing of the cells on the tipping paper, the solution of cells may further comprise one or more fixing agents or suspension stabilisers such as, for example, nitrocellulose, polyvinyl acetate or ethyl cellulose.

Where the cells are yeast cells and the method comprises applying an aqueous solution of yeast cells to the tipping paper, the concentration of yeast cells in the aqueous solution is preferably between about 20% by weight and about 40% by weight.

Where the cells are yeast cells and the method comprises applying a solution of yeast cells in ethyl acetate to the tipping paper, the concentration of yeast cells in the ethyl acetate solution is preferably about 60% by weight.

During manufacture of smoking articles according to the invention, the cells advantageously provide a resistant structure that protects the at least one flavourant encapsulated therein from, for example, high temperature, UV, light, pressure and air degradation. For example, cigarettes or other smoking articles according to the invention may be produced with a plurality of yeast cells having menthol encapsulated therein provided on the surface of at least a mouth end portion thereof. Encapsulation of the menthol in the yeast cells advantageously protects the menthol from evaporation, thereby increasing the shelf life of the menthol flavour in the cigarettes.

Furthermore, while some cells may be broken during manufacture of smoking articles according to the present invention, the proportion of cells that remain intact is sufficiently high that most of the encapsulated flavourant is only released when a consumer places the smoking article between their lips, thereby moistening the surface of the mouth end portion of the smoking article on which the cells are provided.

The size of the cells, typically between about 5 micrometres and about 10 micrometres, provides physical and mechanical resistance so that when, for example, gravure printing is used to apply cells in solution to the surface of tipping paper very little flavourant encapsulated within the cells is lost. However, when a consumer's saliva comes into contact with the surface of the mouth end portion of smoking articles according to the invention upon which the yeast cells or other cells are provided, the complex carbohydrates in the yeast cell wall, which acts as a rigid outer shell, swell and absorb moisture rendering the internal membrane, which controls release of the encapsulated flavourant, permeable. The provision of a plurality of cells capable of releasing at least one flavourant encapsulated therein upon contact with saliva, thereby advantageously enables smoking articles according to the present invention to be designed in which the encapsulated flavourant is rapidly released into the consumer's mouth cavity to produce an intense and concentrated taste.

BRIEF DESCRIPTION OF THE DRAWINGS

The invention will be further described, by way of example only, with reference to the accompanying drawings in which.

DETAILED DESCRIPTION

Figure 1:
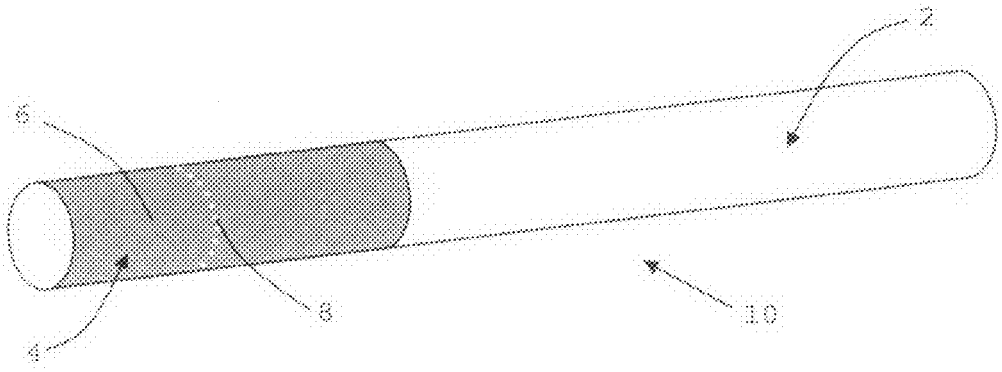
FIG. 1 shows a perspective view of a filter cigarette according to a first embodiment of the invention.
Figure 2:
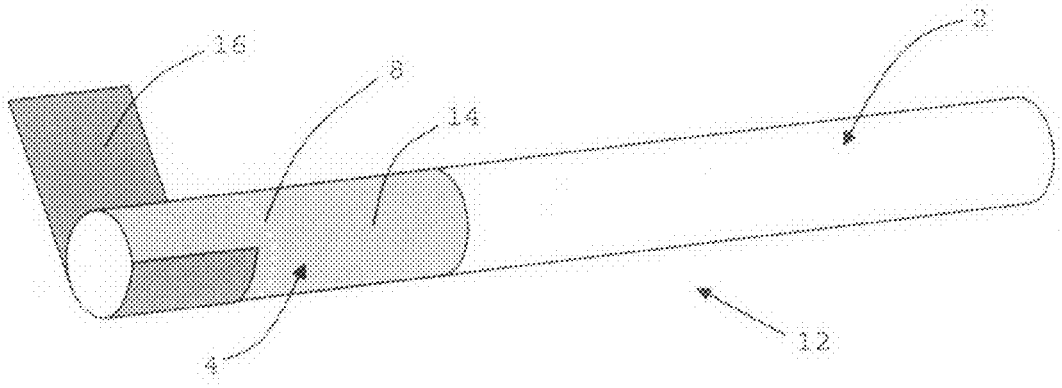
FIG. 2 shows a perspective view of a filter cigarette according to a second embodiment of the invention.

The filter cigarettes according to the first and second embodiments of the invention shown in FIGS. 1 and 2, respectively, have several components in common; these components have been given the same reference numerals throughout.

Each filter cigarette generally comprises an elongate, cylindrical, wrapped, tobacco rod 2 attached at one end to an axially aligned cylindrical filter 4. The wrapped tobacco rod 2 and the filter 4 are joined in a conventional manner to form the filter cigarette by a band of tipping paper, which circumscribes the entire length of the filter 4 and an adjacent portion of the wrapped tobacco rod 2. To ventilate the mainstream smoke produced during combustion of the smoking article, a ring of perforations 8 is provided through the band of tipping paper at a location along the filter 4.

The filter cigarette 10 according to the first embodiment of the invention shown in FIG. 1 comprises a band of tipping paper 6, which circumscribes the entire length of the filter 4 and an adjacent portion of the wrapped tobacco rod 2. The outer surface of the band of tipping paper 6 is coated along its entire length with an aqueous solution of yeast cells having a flavourant encapsulated therein.

To produce filter cigarettes 10 according to the first embodiment of the invention, an aqueous solution of yeast cells having at least one desired flavourant encapsulated therein is formed by mixing an aqueous suspension of yeast and the desired flavourant or flavourants, such as, for example, an essential oil. The desired flavourant or flavourants pass freely through the yeast cell walls and membranes and remain passively within the yeast cells. The yeast cells with the desired flavourant or flavourants encapsulated therein are then dried, by for example spray drying or freeze drying.

The dried product is subsequently re-suspended in an aqueous or non-aqueous solvent at a desired concentration to yield a solution of "yeast encapsulated flavourant", which is applied to tipping paper using gravure printing to coat the surface of the tipping paper with the yeast cells having the flavourant encapsulated therein. Finally, the tipping paper coated with the yeast-encapsulated flavourant is used to join a wrapped tobacco rod 2 and a filter 4 in a known manner to produce a filter cigarette.

It will be appreciated that yeast cells having at least one flavourant encapsulated therein may be deposited over substantially the entire outer surface of the band of tipping paper 6 joining the filter 4 to the wrapped tobacco rod 2, as shown in FIG. 1, or only over a few millimeters of the outer surface of the band of tipping paper 6 at the mouth end of the smoking article.

As shown in FIG. 2, the filter cigarette 12 according to the second embodiment of the invention comprises a first band of conventional tipping paper 14, which joins the wrapped tobacco rod 2 to the filter 4, and a second band of tipping paper 16, which circumscribes the end of first band of tipping paper 14, proximate the mouth-end of the filter 4. The outer surface of the second band of tipping paper 16 is coated with an aqueous solution of yeast cells having a flavourant encapsulated therein. The second band of tipping paper 16 is affixed to the outer the underlying first band of tipping paper 14 with, for example, a polyvinyl alcohol (PVA) or other adhesive.

It will be appreciated that, if desired, the second band of tipping paper 16 of the filter cigarette 12 according to the second embodiment of the invention may be extended to circumscribe substantially the entire length of the first band of tipping paper 14. By increasing the proportion of the first band of tipping paper 14 that is over tipped by the second band of tipping paper 16, the number of yeast cells provided on the surface of the mouth end of the filter cigarette 12 may be increased. In use, a greater quantity of encapsulated flavourant may advantageously be released from the increased number of yeast cells and hence a more intense gustatory sensation potentially provided to the consumer.

The outer surface of the distal end of the first band of tipping paper 14, distant from the mouth end of the filter 4, may be printed with, for example, manufacturer or brand logos, trade marks or slogans in a conventional manner. Where the first band of tipping paper 14 is printed in this manner, the length of the second band of tipping paper 16 from the mouth end of the filter 4 is preferably less than the length of the first band of tipping paper 14, so that the printing is not obscured by the second band of tipping paper 16. For example, in filter cigarettes according to the second embodiment of the invention having a first band of tipping paper 14 with a length of 32 mm, the maximum length of the second band of tipping paper 16 from the mouth end of the filter 4 is preferably about 27 mm.

Filter cigarettes 12 according to the second embodiment of the invention may comprise a second band of tipping paper 16 that overlies perforations 8 provided in the first band of tipping paper 14. In such filter cigarettes 12, the second band of tipping paper 16 may be perforated, by for example macro laser perforation, in the area overlying the perforations 8, to enable ventilating air to flow freely through both the second 16 and first 14 bands of tipping paper into the filter 4 during combustion of the filter cigarette 12.

To produce filter cigarettes 12 according to the second embodiment of the invention, a wrapped tobacco rod 2 and a filter 4 are initially joined in a known manner by a first band of conventional tipping paper 14. At least a mouth end portion of the first band of conventional tipping paper 14 is then over tipped in a known manner with a second band of tipping paper 16, the outer surface of which has been coated with a solution of yeast cells having at least one flavourant encapsulated therein as previously described.

EXAMPLES

Yeast cells having the mentholated flavourants of Examples 1 and Example 2, encapsulated therein are produced in a known manner.

Example 1

| | |
|---|---|
| Flavourant: | Peppermint |
| Total encapsulation level (mg/g): | 277 |
| Menthol encapsulated (mg/g): | 107 |

Example 2

| | |
|---|---|
| Flavourant: | Menthol/Peppermint |
| Total encapsulation level (mg/g): | 267 |
| Menthol encapsulated (mg/g): | 167 |

Tipping papers coated with the yeast encapsulated flavourants of Examples 1 and 2 are produced by applying aqueous solutions of the yeast encapsulated flavourings in warm tap water to tipping paper sold under the brand name MS 900 BN by Papeteries de Malaucene. The solutions are applied to the wire side of the tipping paper using gravure printing and a Saueressig automatic coater with a laboratory scale engraved cylinder and the coated tipping papers then dried in ambient air.

The quantity of the yeast encapsulated flavourants of Examples 1 and 2 coated on the tipping papers, expressed in grams of yeast encapsulated flavourant per square metre of paper, are given below in Tables 1 and 2, respectively. The menthol and menthone contents (in % w/w of paper) of the coated tipping papers, extracted and analysed by high pressure liquid chromatography (HPLC), are also given in Tables 1 and 2.

TABLE 1

| Solution Concentration | Quantity applied ($g/m^2$) | Menthol Content (% w/w) | Menthone Content (% w/w) |
|---|---|---|---|
| 20% (w/w) yeast | 1.1 | 0.2 | 0.6 |
| 30% (w/w) yeast | 1.6 | 0.4 | 0.1 |
| 40% (w/w) yeast | 2.0 | 0.3 | 0.1 |

TABLE 2

| Solution Concentration | Quantity applied ($g/m^2$) | Menthol Content (% w/w) | Menthone Content (% w/w) |
|---|---|---|---|
| 20% (w/w) yeast | 0.8 | 0.3 | 0 |
| 30% (w/w) yeast | 1.7 | 0.4 | 0 |
| 40% (w/w) yeast | 2.0 | 0.6 | 0 |

Filter cigarettes according to the invention having the general construction shown in FIG. 2 are prepared by over tipping:

(i) conventional low tar filter cigarettes with a total tar delivery of 1 mg; and (ii) conventional non-ventilated filter cigarettes with a total tar delivery of 9 mg, with the tipping papers coated with the yeast encapsulated flavourants of Examples 1 and 2.

The conventional low tar filter cigarettes in (i) were over tipped to a length of 10 mm from the mouth end of the filter and the conventional non-ventilated filter cigarettes in (ii) were over tipped to a length of 25 mm from the mouth end of the filter. In both cases, the coated tipping paper is adhered to the filter cigarettes with PVA adhesive.

The odour of the menthol/peppermint flavourants released in the direct environment of the filter cigarettes according to the invention is very low prior to smoking due to the encapsulation of the flavourants in the yeast cells. However, when the tipping papers coated with the yeast encapsulated flavourants are brought into contact with saliva, moisture from the saliva causes the yeast cells to swell and release the flavourants, producing a gustatory sensation. The filter cigarettes with coated tipping papers having the highest menthol loading provide the most intense flavor sensation.

For ventilated 1 mg tar filter cigarettes according to the invention, the gustatory sensation produced by the flavourant is still perceived to some extent during smoking of the cigarettes. For the non-ventilated 9 mg tar filter cigarettes according to the invention, the gustatory sensation produced by the flavourant is virtually imperceptible during smoking of the cigarettes.

While the invention has been exemplified with reference to filter cigarettes, it will be appreciated that other types of smoking article according to the invention may also be produced such as, for example, cigars, cigarillos and non-filter cigarettes.

The invention claimed is:

1. A smoking article having a plurality of yeast cells provided on an outer surface of a mouth end portion thereof, the cells having at least one flavourant encapsulated therein.

2. A smoking article according to claim 1 comprising:

a tobacco rod; and a filter attached to the tobacco rod, wherein the plurality of yeast cells are provided on at least a portion of the outer surface of the filter.

3. A smoking article according to claim 2 wherein the filter is attached to the tobacco rod by a second band of tipping paper and the plurality of yeast cells are deposited on the outer surface of the second band of tipping paper.

4. A smoking article according to claim 2 wherein the filter is attached to the tobacco rod by a first band of tipping paper and the plurality of yeast cells are deposited on the outer surface of a second band of tipping paper circumscribing at least a mouth end portion of the first band of tipping paper.

5. A method of making a smoking article according to claim 3 comprising:

applying a solution of yeast cells having at least one flavourant encapsulated therein to a tipping paper; and circumscribing at least a mouth end portion of the filter with the tipping paper.

6. A method according to claim 5 wherein the solution of yeast cells is applied to the tipping paper by gravure printing.

7. A method according to claim 5 comprising applying an aqueous solution of yeast cells to the tipping paper, wherein the concentration of yeast cells in the aqueous solution is between 20% by weight and 40% by weight.

8. A method according to claim 5 comprising applying a solution of yeast cells in ethyl acetate to the tipping paper.

9. A method according to claim 8 wherein the concentration of yeast cells in the ethyl acetate solution is about 60% by weight.

10. A method of making a smoking article comprising:

applying a solution of yeast cells in ethyl acetate to a tipping paper; and circumscribing at least a mouth end portion of a filter with the tipping paper.

* * * * *